US011774911B2

(12) United States Patent
Saglini

(10) Patent No.: US 11,774,911 B2
(45) Date of Patent: Oct. 3, 2023

(54) TIMEPIECE INDEXING ELEMENT

(71) Applicant: ETA SA Manufacture Horlogere Suisse, Grenchen (CH)

(72) Inventor: Julien Saglini, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 741 days.

(21) Appl. No.: 16/896,485

(22) Filed: Jun. 9, 2020

(65) Prior Publication Data

US 2021/0041836 A1 Feb. 11, 2021

(30) Foreign Application Priority Data

Aug. 8, 2019 (EP) ..... 19190678

(51) Int. Cl.

| | |
|---|---|
| ***G04B 27/00*** | (2006.01) |
| ***G04B 13/02*** | (2006.01) |
| ***G04B 19/02*** | (2006.01) |
| ***G04B 19/253*** | (2006.01) |

(52) U.S. Cl.

CPC ..... *G04B 27/005* (2013.01); *G04B 13/023* (2013.01); *G04B 19/02* (2013.01); *G04B 19/253* (2013.01)

(58) Field of Classification Search

CPC .... G04B 27/005; G04B 13/023; G04B 19/02; G04B 19/253

See application file for complete search history.

(56) References Cited

U.S. PATENT DOCUMENTS

| | | | |
|---|---|---|---|
| 3,765,162 | A | 10/1973 | Ushiyama et al. |
| 3,844,107 | A | 10/1974 | Guyot |
| 4,634,287 | A | 1/1987 | Vuilleumier et al. |
| 2005/0128875 | A1 | 6/2005 | Bron |

(Continued)

FOREIGN PATENT DOCUMENTS

| | | | |
|---|---|---|---|
| CN | 101441433 | A | 5/2009 |
| CN | 102207728 | A | 10/2011 |

(Continued)

OTHER PUBLICATIONS

European Search Report dated Jan. 29, 2020 in European Application 19190678.3 filed on Aug. 8, 2019 (with English Translation of Categories of Cited Documents), 8 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A timepiece indexing element cooperating coaxially with a component including an indexing relief element defining indexing positions, including a first bearing surface cooperating in abutment with the component, elastic return device exerting a radial thrust on this component to press it onto this first bearing surface, and indexing device cooperating with the indexing relief element, these elastic return devices include at least a first elastic arm including a first indexing surface comprised in this indexing device and arranged to exert a radial thrust force on the component and, at least a second elastic arm arranged to exert a radial thrust force on the first elastic arm.

22 Claims, 4 Drawing Sheets

(56) References Cited

U.S. PATENT DOCUMENTS

| | | | | |
|---|---|---|---|---|
| 2011/0205856 | A1* | 8/2011 | Zaugg | G04B 19/02 368/185 |
| 2012/0195169 | A1 | 8/2012 | Courvoisier | |
| 2015/0168915 | A1* | 6/2015 | Fleury | G04B 11/00 368/154 |
| 2016/0026154 | A1* | 1/2016 | Courvoisier | G04B 13/022 368/184 |
| 2016/0170373 | A1 | 6/2016 | Marechal et al. | |
| 2017/0351219 | A1* | 12/2017 | Paratte | G04B 18/00 |

FOREIGN PATENT DOCUMENTS

| | | | |
|---|---|---|---|
| CN | 204009381 | U | 12/2014 |
| CN | 105319943 | A | 2/2016 |
| CN | 106537262 | A | 3/2017 |
| EP | 0 173 230 | A1 | 5/1988 |
| EP | 0 173 230 | B1 | 5/1988 |
| EP | 1 637 941 | A1 | 3/2006 |
| EP | 1 895 370 | A2 | 3/2008 |
| EP | 1 544 691 | A1 | 5/2008 |
| EP | 1 544 691 | B1 | 5/2008 |
| EP | 2 309 346 | A1 | 4/2011 |
| EP | 2 224 294 | A1 | 9/2014 |
| EP | 2 224 294 | B1 | 9/2014 |
| EP | 3 032 347 | A1 | 6/2017 |
| EP | 3 032 347 | B1 | 6/2017 |
| FR | 2 124 469 | A1 | 9/1972 |

OTHER PUBLICATIONS

Combined Chinese Office Action and Search Report dated Jun. 9, 2021 in Patent Application No. 202010782462.9 (with English translation of Category of Cited Documents), 7 pages.

* cited by examiner

TIMEPIECE INDEXING ELEMENT

CROSS-REFERENCE TO RELATED APPLICATION

This application claims priority to European Patent Application No. 19190678.3 filed on Aug. 8, 2019, the entire disclosure of which is hereby incorporated herein by reference.

FIELD OF THE INVENTION

The invention concerns a timepiece indexing element, arranged to cooperate in a substantially coaxial manner, about an axis about which said indexing element extends, with a timepiece component comprising an indexing relief element defining a plurality of indexing positions, said indexing element comprising a first bearing surface arranged to cooperate in abutment with a second complementary bearing surface comprised in a said component, and comprising elastic return means arranged to exert a substantially radial thrust force with respect to said axis on a said component in order to press it against said first bearing surface, and comprising indexing means arranged to cooperate with a said indexing relief element of a said component for relative indexing between said indexing element and said component.

The invention further concerns a timepiece assembly comprising at least one such indexing element, and at least one such timepiece component comprising an indexing relief element defining a plurality of indexing positions, said at least one indexing element and said at least one component being arranged to cooperate with one another in a substantially coaxial manner, about said axis, for the relative indexing of one with respect to the other.

The invention also concerns a timepiece mechanism including at least one indexing element, and/or at least one such timepiece assembly.

The invention also concerns a timepiece, notably a watch, including at least one such timepiece mechanism and/or at least one such indexing element and/or on such timepiece assembly.

The invention also concerns the field of timepiece mechanisms, and, in particular, display and/or setting and/or selection mechanisms.

BACKGROUND OF THE INVENTION

In timepiece display mechanisms such as time zone displays, the time zone/jumping hour wheels are often formed of several plates/pinions, connected to each other by a star/cam stressed by a spring element (click). Such systems occupy significant space.

The spring elements of these systems are often pushed to their maximum, which means it is not possible to obtain high deflection values, which are nevertheless required to ensure winding and operation. Furthermore, dimensional variations during production cause significant force variations in these springs, thus the forces are not reproducible.

SUMMARY OF THE INVENTION

The invention proposes not only to make the setting and indexing mechanisms more reliable, but to reduce their thickness, and to guarantee precise and controlled indexing between two elements.

Here too, it is a question of limiting the stresses to which the elastic elements are subjected.

Finally, it is necessary to eliminate the dispersion of force values, responsible for the difficulty in complying with production tolerances in a reproducible manner.

To this end, the invention concerns a timepiece indexing mechanism according to claim 1.

The invention further concerns a timepiece assembly comprising at least one such indexing element, and at least one such timepiece component comprising an indexing relief element defining a plurality of indexing positions, said at least one indexing element and said at least one component being arranged to cooperate with one another in a substantially coaxial manner, for the relative indexing one with respect to the other.

The invention also concerns a timepiece mechanism including at least one indexing element, and/or at least one such timepiece assembly.

The invention also concerns a timepiece, notably a watch, including at least one such timepiece mechanism and/or at least one such indexing element and/or on such timepiece assembly.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
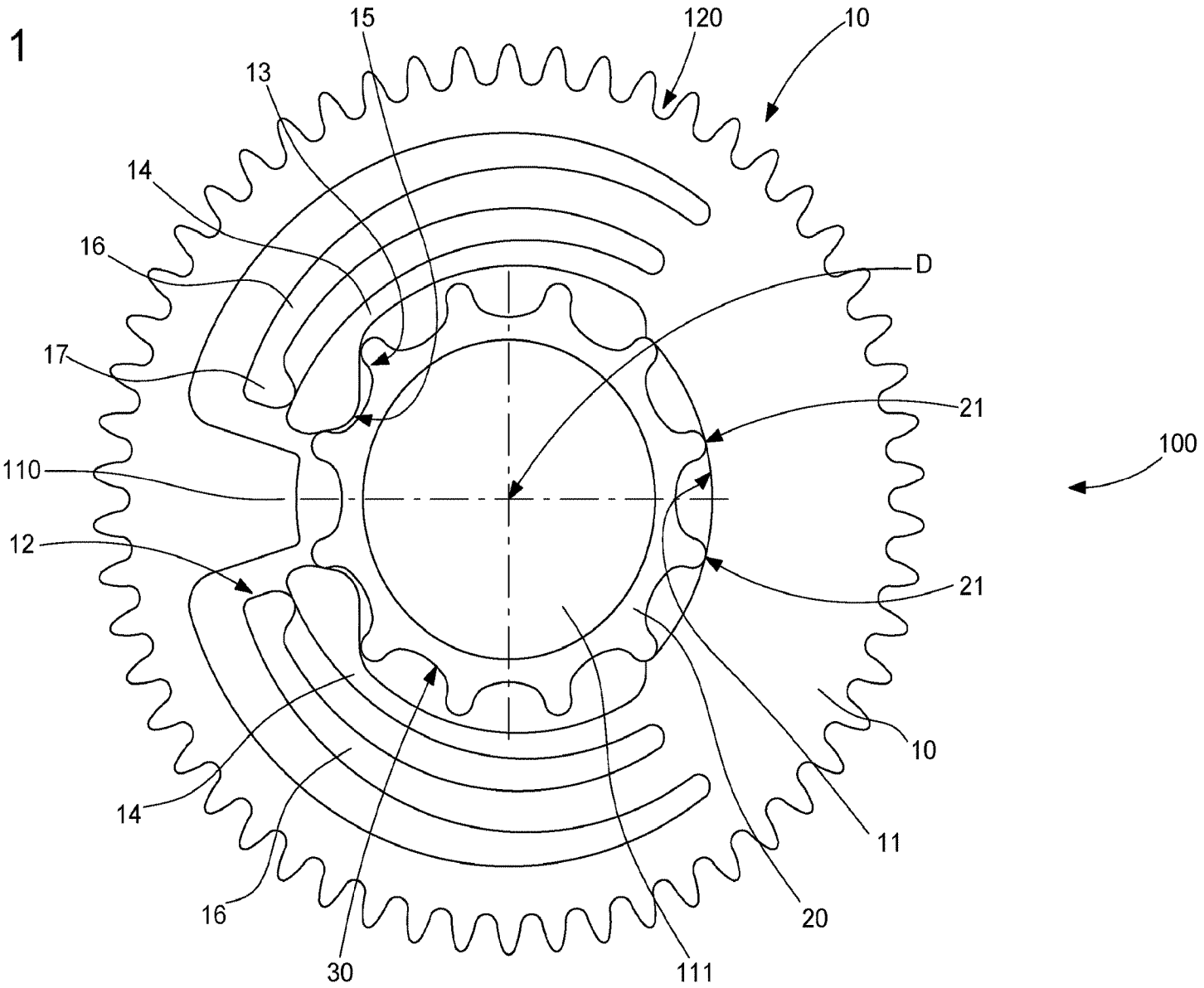
FIG. 1 represents a schematic flat view of a timepiece assembly according to the invention, comprising, on the one hand, an indexing element which is a toothed wheel here, comprising, cut into its plate, two pairs of elastic arms, and on the other hand, a timepiece component comprising an indexing relief element defining a plurality of indexing positions, this indexing relief element consisting here of a toothing; the indexing element and the component cooperating with one another in a coaxial manner, one resting inside the other. In each pair of elastic arms, the innermost arm performs the indexing by cooperating with the indexing relief element, and first presses on the latter. In each pair, the outermost elastic arm, coplanar with the inner arm, presses on the latter with a return torque greater than its own. This Figure is represented in a stable indexed position.

The invention concerns a timepiece indexing element 10, arranged to cooperate in a substantially coaxial manner, about an axis D about which indexing element 10 extends, with a timepiece component 20:

This component 20 includes an indexing relief element 30, defining a plurality of indexing positions. This indexing relief element can be formed by a toothing, as illustrated by the Figures, or by a flute, or by notches, or protuberances, or pins, or otherwise.

Indexing element 10 includes a first bearing surface 11, which is arranged to cooperate in abutment with a second complementary bearing surface 21 comprised in such a component 20. This contact area between indexing element 10 and component 20 ensures the perfect positioning of one relative to the other: the position of each is both known and controlled.

Indexing element 10 comprises elastic return means 12, which are arranged to exert a substantially radial thrust force, with respect to axis D, on such a component 20, to press it onto first bearing surface 11.

Indexing element 10 comprises indexing means 13, which are arranged to cooperate with an indexing relief element 30 of a component 20 for relative indexing between indexing element 10 and component 20.

According to the invention, elastic return means 12 comprise at least a first elastic arm 14, comprising a first indexing surface 15 comprised in indexing means 13. And this first elastic arm 14 is arranged to exert a substantially radial thrust force with respect to axis D on such a component 20. Elastic return means 12 also comprise at least a second elastic arm 16, which is arranged to exert a substantially radial thrust force with respect to axis D on at least a first elastic arm 14.

More particularly, in a pair formed by a first elastic arm 14 and a second elastic arm 16, the second elastic arm 16 is arranged to exert a return torque higher than the return torque of first elastic arm 14.

More particularly, in a pair formed by a first elastic arm 14 and a second elastic arm 16, the second elastic arm 16 is arranged to travel, in its bending stroke, a smaller radial extension (or deflection) than that of first elastic arm 14.

Figure 2:
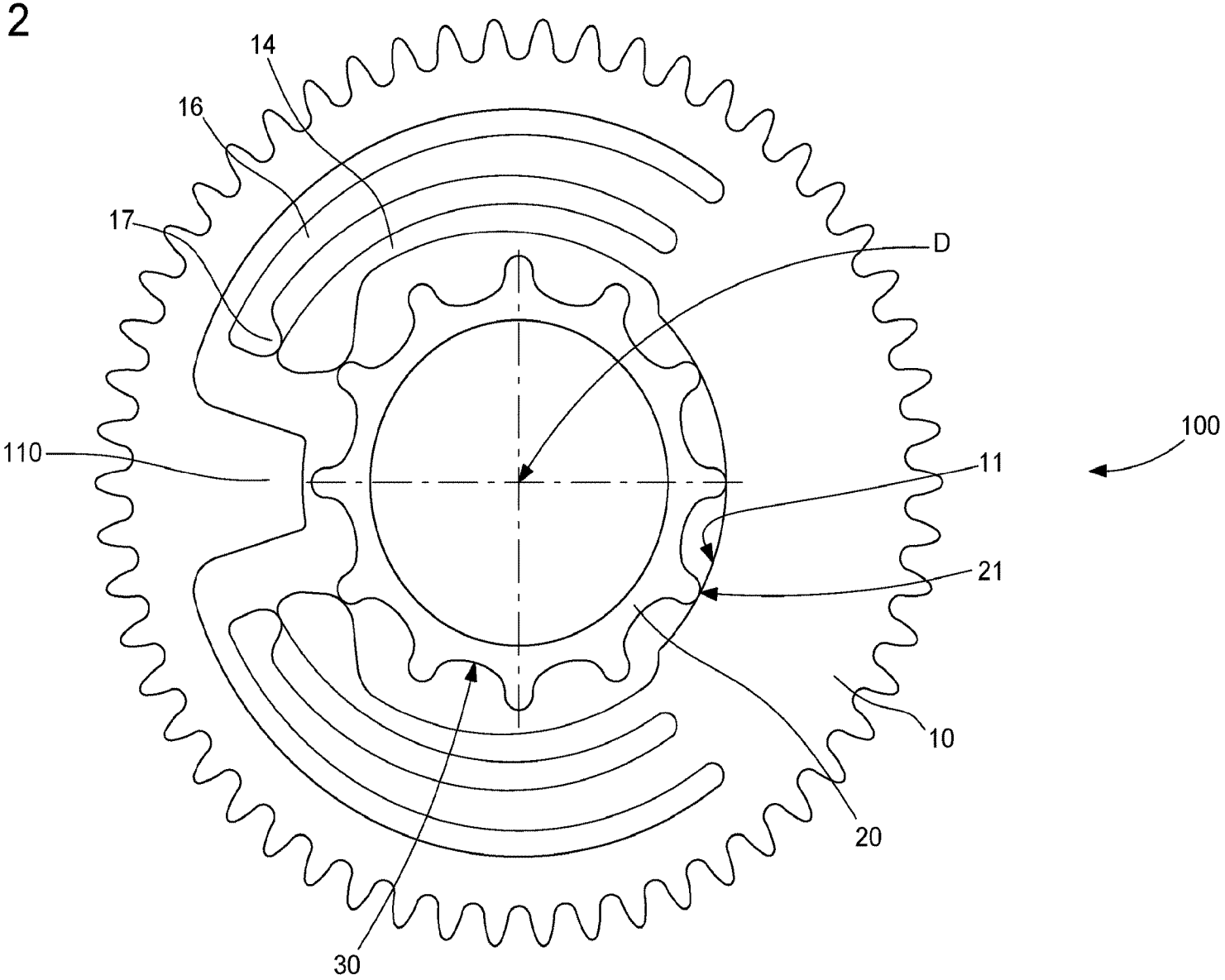
FIG. 2 represents, in a similar manner to FIG. 1, the same mechanism in a transition position, in which the inner elastic arms are pressing on the tips of the teeth of the indexing relief element; the inner and outer arms are then in their maximum radial elongation.
Figure 3:
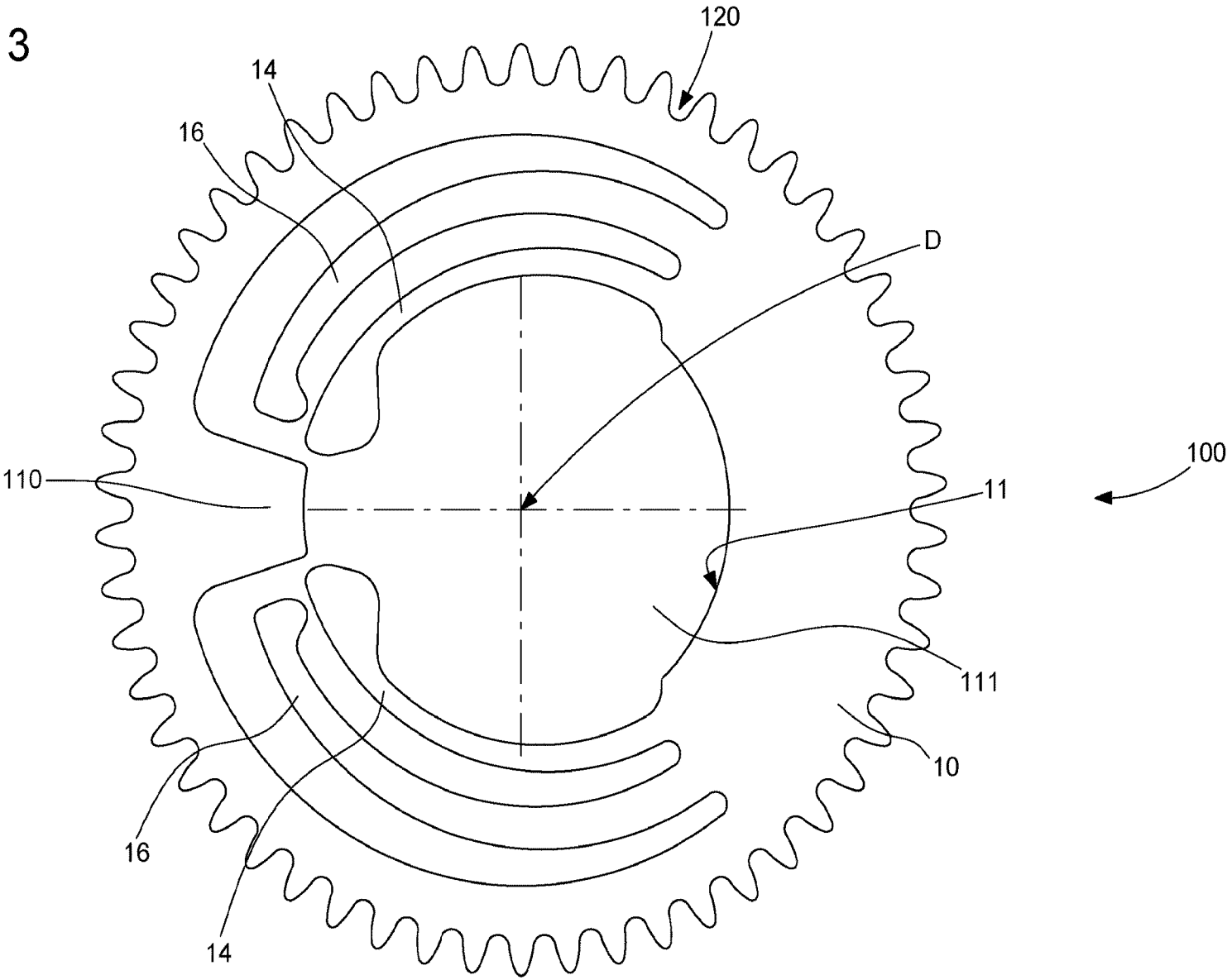
FIG. 3 represents, in a similar manner to FIG. 1, the indexing element alone, in a free state, in which the inner and outer elastic arms are in a rest position, in close proximity to the axis.

For example, in the mechanism illustrated in FIGS. 1 to 3, applied to driving the time and a date indicator of a watch, first inner elastic arm 14 has a deflection of 0.26 mm, while that of second elastic arm 16 is 0.21 mm. This arrangement makes it possible to maintain the torque, and to guarantee here a minimum torque of 1.2 N·nm.

In particular, and as illustrated by the Figures, indexing element 10 comprises a plurality of pairs (two pairs in the non-limiting case of the Figures), each formed by a first elastic arm 14 and a second elastic arm 16, and each arranged to exert on a component 20 a substantially diametrically opposite force, with respect to axis D, to first bearing surface 11.

More particularly, at least a second elastic arm 16 comprises a lug 17 which is arranged to cooperate with a notch 18 comprised in a first elastic arm 14 with which this second elastic arm 16 cooperates, to lock first elastic arm 14 in the indexing position, in the factory or in an after-sales service centre; to be implemented by a user, such a variant requires the arrangement of complementary means, not illustrated here, for releasing lug 17 from notch 18.

More particularly, indexing element 10 comprises at least one locking element 19, which is arranged to lock a second elastic arm 16 in abutment on a first elastic arm 14 with which this second elastic arm 16 cooperates; such locking may be locking with slight play, to allow a short radial travel of first elastic arm 14 and of second elastic arm 16 in case of shock, when the mechanism is incorporated in a watch; here too, this locking operation concerns a factory setting or an adjustment carried out in an after-sales service centre.

Advantageously, and as visible in the Figures, indexing element 10 comprises at least one boss 110, diametrically opposite, with respect to axis D, to first bearing surface 11, to form an anti-shock stop member limiting the relative radial movement, in case of shock, between indexing element 10 and a component 20 assembled to one another in an indexed position.

In a variant illustrated by FIGS. 1 to 3, indexing element 10 comprises an inner chamber 111, which is delimited by bearing surface 11 and each first elastic arm 14, and arranged to surround an indexing relief element 30 of component 20, and each first elastic arm 14, is closer to axis D than each second elastic arm 16.

Figure 4:
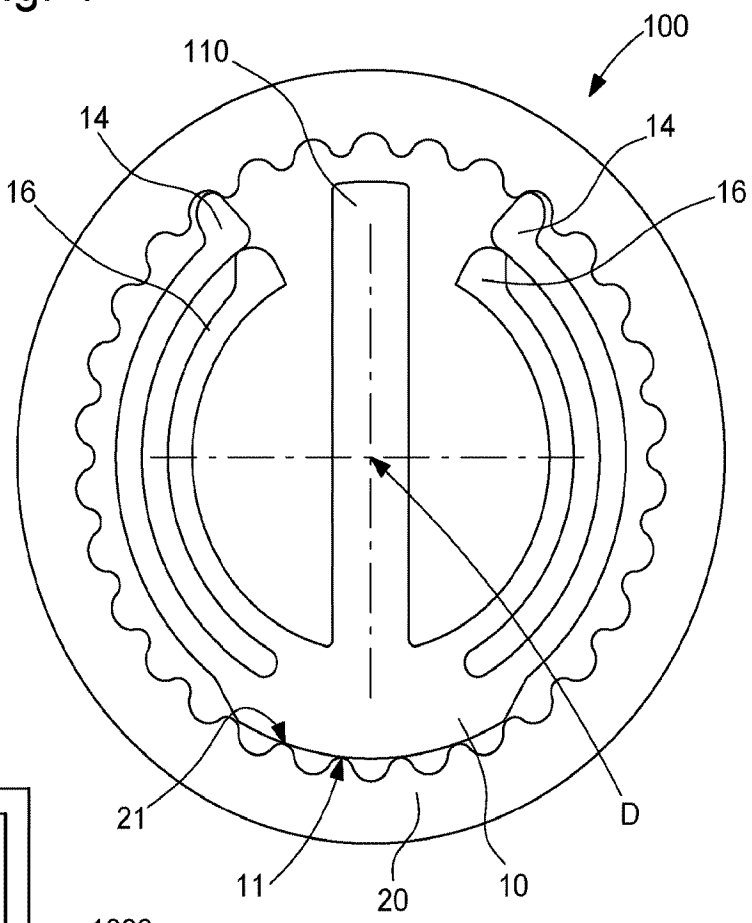
FIG. 4 represents, in a similar manner to FIG. 1, a reverse configuration, wherein the component comprising the indexing relief element surrounds the indexing element, and wherein the outer elastic arms cooperate with the latter, while the inner elastic arms press on the outer elastic arms.
Figure 7:
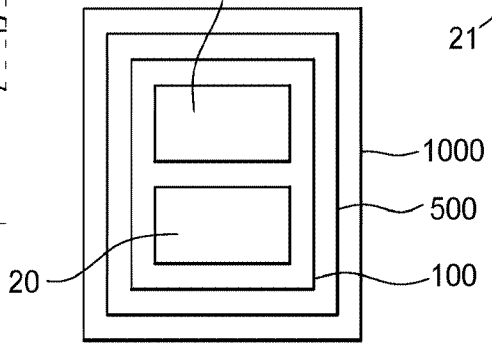
FIG. 7 is a block diagram representing a timepiece, notably a watch, including a timepiece mechanism which in turn includes one such assembly with one such indexing element, and one such component.
Figure 5:
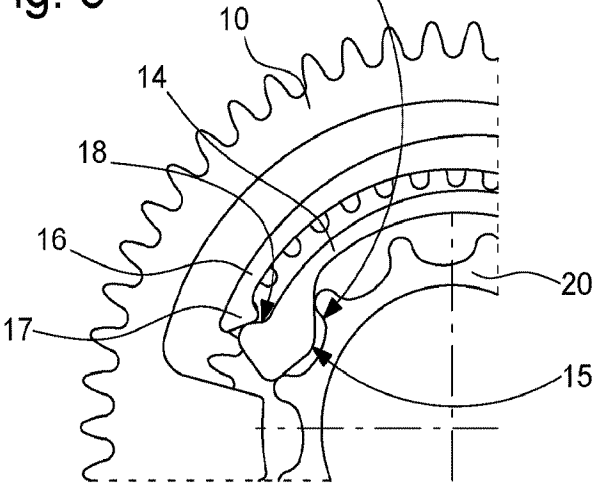
FIG. 5 represents, in a similar manner to FIG. 1, a detail of a variant wherein the inner elastic arm comprises a notch with which a boss of the outer elastic arm can cooperate.
Figure 6:
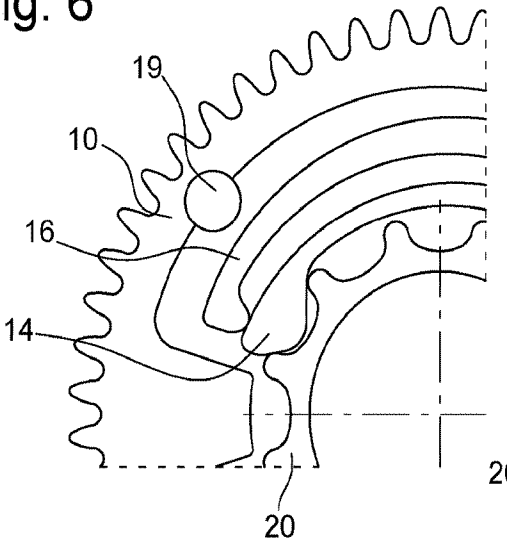
FIG. 6 represents, in a similar manner to FIG. 1, a detail of another variant wherein a locking member, such as a pin, is inserted in the factory after a setting operation, to restrict the movement of the inner elastic arm and of the outer elastic arm to a simple set of shock absorbers, but does not allow a change of indexing without the prior removal of the locking member.

In another variant illustrated by FIG. 4, indexing element 10 is arranged to be inserted into an external chamber delimited by an indexing relief element 30 of a component 20, and each first elastic arm 14 is further away from axis D than each second elastic arm 16.

It is clear that the invention can be used equally with indexing element 10 movable and component 20 fixed, or indexing element fixed and component 20 movable, or indexing element 10 and component 20 both movable, or indexing element 10 and component 20 both fixed for a factory setting, for example.

In a variant, indexing element 10 is a wheel set arranged to pivot about axis D and about a component 20 with which it cooperates.

More particularly, indexing element 10 comprises drive means 120, such as a toothing, a flute, notches, pierced holes, protuberances, pins, pegs, grooves in a belt or chain, or otherwise.

In a variant, indexing element 10 is arranged to be secured in a fixed angular position on a structure of a timepiece movement or mechanism.

More particularly, indexing element 10 is made of micromachinable material by a "LIGA" type method (from the German Röntgenlithographie, Galvanoformung, Abformung or Lithography, Electroplating, Moulding) or similar, made of silicon, or silicon oxide, or nickel-phosphorus NiP, or any similar material currently commonly used in horology and suitable for making one-piece components of small thickness comprising elastic strips.

Preferably, within a same pair, the first elastic arm 14 and second elastic arm 16 are substantially parallel to one another. In a particular arrangement, and as illustrated by the Figures, first elastic arms 14 and second elastic arms 16 are curved, notably substantially circular and centred on axis D, for good stress distribution.

The invention lends itself particularly well to the production of watch components, of small dimensions, for example, with an overall diameter of less than 5 mm, and a thickness of a few tenths of a millimetre.

The invention further concerns a timepiece assembly 100 comprising at least one such indexing element 10, and at least one such timepiece component 20 comprising an indexing relief element 30 defining a plurality of indexing positions. This at least one indexing element 10 and this at least one component 20 are arranged to cooperate with one another in a substantially coaxial manner, about axis D, for the relative indexing of one with respect to the other, with first bearing surface 11 arranged to cooperate in abutment with a second complementary bearing surface 21 comprised in this at least one component 20, and indexing means 13 arranged to cooperate with an indexing relief element 30 of such a component 20 for relative indexing between the indexing element 10 and component 20 concerned.

In the variant of FIGS. 1 to 3, indexing element 10 comprises an inner chamber 111, delimited by bearing surface 11 and each first elastic arm 14, arranged to surround an indexing relief element 30 of a component 20, and each first elastic arm 14 is closer to axis D than each second elastic arm 16.

In the variant of FIG. 4, indexing element 10 is arranged to be inserted into an external chamber delimited by an indexing relief element 30 of a component 20, and each first elastic arm 14 is further away from axis D than each second elastic arm 16.

More particularly, timepiece assembly 100 includes a single indexing element 10, and a single component 20.

In a variant, component 20 is a wheel set.

In another variant, component 20 is arranged to be secured in a fixed angular position on a structure of a timepiece movement or mechanism.

More particularly, indexing element 10 and indexing relief element 30 of component 20 are both delimited by the same upper plane and the same lower plane, perpendicular to axis D. More particularly still, they have the same thickness.

The invention also concerns a timepiece movement 500 including at least one such indexing element 10, and/or at least one such timepiece assembly 100.

The invention also concerns a timepiece 1000, particularly a watch, including at least one such timepiece mechanism 500, and/or at least one indexing element 10 and/or one timepiece assembly 100.

Compared to the prior art where it was common to juxtapose a toothed wheel side-by-side with spring elements, the invention, while ensuring the uncoupling of the two indexed elements, makes it possible to save one level on the z-axis, i.e. to reduce the total thickness.

Placing two elastic arms, or spring elements in parallel, makes it possible to obtain the desired torque, to limit the stresses experienced, and to have a large bending deflection (radial extension of the elastic arms). A large bending deflection makes it possible to reduce the effect of production variations.

Within each pair, one of the elastic arms ensures the positioning and indexing functions and part of the support torque, and the other spring ensures most of the resultant support torque.

Although the invention is illustrated here with an indexing element 10 and a component 20 which are both toothed wheels, it is understood that the invention lends itself to numerous timepiece applications: column wheel, date ring, time zone indicator, lever, display disc, day/night indicator, AM/PM indicator, leap year display, moon phase, or otherwise.

Finally, proper orientation of the bearing forces exerted by the spring elements makes it possible to position one element with respect to the other, in a known manner, at any time.

In short, the invention makes it possible to save a considerable amount of space, particularly in height, to minimise the risk of breakage of spring elements, and to ensure better control of forces.

The invention claimed is:

1. A timepiece indexing element, arranged to cooperate in a substantially coaxial manner, about an axis about which said indexing element extends, with a timepiece component comprising an indexing relief element defining a plurality of indexing positions, said indexing element comprising a first bearing surface arranged to cooperate in abutment with a second complementary bearing surface comprised in said component, and comprising elastic return means arranged to exert a substantially radial thrust force, with respect to said axis, on said component, to press said component onto said first bearing surface, and comprising indexing means arranged to cooperate with said indexing relief element of said component for relative indexing between said indexing element and said component, wherein said elastic return means comprise at least a first elastic arm comprising a first indexing surface comprised in said indexing means and which is arranged to exert a substantially radial thrust force with respect to said axis on said component, and at least a second elastic arm arranged to exert a substantially radial thrust force with respect to said axis on said at least one first elastic arm.

2. The indexing element according to claim 1, wherein, in a pair formed by said first elastic arm and said second elastic arm, said second elastic arm is arranged to exert a higher return torque than the return torque of said first elastic arm.

3. The indexing element according to claim 1, wherein, in a pair formed by said first elastic arm and said second elastic arm, said first elastic arm is arranged to travel, in its bending stroke, a greater radial extension than that of said second elastic arm.

4. The indexing element according to claim 1, wherein said indexing element comprises a plurality of pairs, each formed by one said first elastic arm and one said second elastic arm, and each arranged to exert on said component a substantially diametrically opposite force, with respect to said axis, to said first bearing surface.

5. The indexing element according to claim 1, wherein at least one said second elastic arm comprises a lug arranged to cooperate with a notch comprised in said first elastic arm with which said second elastic arm cooperates, to lock said first elastic arm in the indexing position.

6. The indexing element according to claim 1, wherein said indexing element comprises at least one locking element arranged to lock said second elastic arm in abutment on said first elastic arm with which said second elastic arm cooperates.

7. The indexing element according to claim 1, wherein said indexing element comprises at least one boss, diametrically opposite, with respect to axis, to said first bearing surface, to form an anti-shock stop member limiting the relative radial movement, in case of shock, between said indexing element and said component assembled to one another in an indexed position.

8. The indexing element according to claim 7, wherein said indexing element comprises an inner chamber, delimited by said bearing surface and each said first elastic arm, arranged to surround said indexing relief element of said component, and wherein each said first elastic arm is closer to said axis than each said second elastic arm.

9. The indexing element according to claim 1, wherein said indexing element is arranged to be inserted into an external chamber delimited by said indexing relief element of said component, and wherein each said first elastic arm is further away from said axis than each said second elastic arm.

10. The indexing element according to claim 1, wherein said indexing element is a wheel set arranged to pivot about said axis and about said component with which said wheel set cooperates.

11. The indexing element according to claim 10, wherein said indexing element comprises drive means.

12. The indexing element according to claim 1, wherein said indexing element is arranged to be secured in a fixed angular position on a structure of a timepiece movement or mechanism.

13. The indexing element according to claim 1, wherein said indexing element is made of nickel-phosphorus NiP.

14. A timepiece assembly comprising said at least one indexing element according to claim 1, and said at least one timepiece component comprising said indexing relief element defining said plurality of indexing positions, said at least one indexing element and said at least one component being arranged to cooperate with one another in a substantially coaxial manner, about said axis, for the relative indexing of one with respect to the other, with said first bearing surface arranged to cooperate in abutment with said second complementary bearing surface comprised in said at least one component, and said indexing means arranged to cooperate with said indexing relief element of said component for relative indexing between said indexing element and said component.

15. The timepiece assembly according to claim 14, wherein said indexing element comprises an inner chamber, delimited by said bearing surface and each said first elastic arm, arranged to surround said indexing relief element of said component, and wherein each said first elastic arm is closer to said axis than each said second elastic arm.

16. The timepiece assembly according to claim 14, wherein said indexing element is arranged to be inserted into an external chamber delimited by said indexing relief element of said component, and wherein each said first elastic arm is further away from said axis than each said second elastic arm.

17. The timepiece assembly according to claim 14, wherein said timepiece assembly comprises only one said indexing element and only one said component.

18. The timepiece assembly according to claim 14, wherein said component is a wheel set.

19. The timepiece assembly according to claim 14, wherein said component is arranged to be secured in a fixed angular position on a structure of a timepiece movement or mechanism.

20. The timepiece assembly according to claim 14, wherein said indexing element and said indexing relief element of the component are both delimited by the same upper plane and the same lower plane, perpendicular to said axis.

21. A timepiece mechanism including at least one indexing element according to claim 1.

22. A timepiece comprising at least one timepiece mechanism according to claim 20.

* * * * *